US010764662B2

(12) United States Patent
Nakamura et al.

(10) Patent No.: US 10,764,662 B2
(45) Date of Patent: Sep. 1, 2020

(54) SPEAKER SYSTEM AND ENCLOSURE STRUCTURE OF SPEAKER SYSTEM

(71) Applicants: DENSO TEN Limited, Kobe-shi, Hyogo (JP); TOYOTA JIDOSHA KABUSHIKI KAISHA, Toyota-shi, Aichi-ken (JP)

(72) Inventors: Masashi Nakamura, Kobe (JP); Masahito Isayama, Kobe (JP); Takashi Moriki, Kobe (JP); Kazuhiko Hamada, Kobe (JP); Isamu Umegaki, Kobe (JP); Shunsuke Kobayashi, Nagakute (JP); Koji Sagata, Nisshin (JP)

(73) Assignees: DENSO TEN Limited, Kobe-shi (JP); TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 16/359,412

(22) Filed: Mar. 20, 2019

(65) Prior Publication Data

US 2019/0313173 A1 Oct. 10, 2019

(30) Foreign Application Priority Data

Apr. 6, 2018 (JP) ..... 2018-074183

(51) Int. Cl.
*H04R 1/02* (2006.01)

(52) U.S. Cl.
CPC ..... *H04R 1/025* (2013.01); *H04R 2400/11* (2013.01); *H04R 2499/13* (2013.01)

(58) Field of Classification Search
CPC ..... H04R 1/025; H04R 2400/11; H04R 2499/19; H04R 2499/13
USPC ..... 381/86, 308, 302, 338, 389, 386
See application file for complete search history.

(56) References Cited

U.S. PATENT DOCUMENTS

| | | | | |
|---|---|---|---|---|
| 9,549,243 | B2 * | 1/2017 | Stys | H04R 1/021 |
| 10,486,614 | B2 * | 11/2019 | Negishi | H04R 1/026 |
| 2007/0154055 | A1 * | 7/2007 | Nichols | H04R 1/025 381/389 |
| 2009/0185709 | A1 * | 7/2009 | Linhard | B60R 13/0237 381/389 |
| 2009/0279733 | A1 * | 11/2009 | Schuster | B60R 13/0237 381/389 |
| 2012/0027222 | A1 * | 2/2012 | Kirsch | B60R 11/0217 381/86 |

(Continued)

FOREIGN PATENT DOCUMENTS

| | | | |
|---|---|---|---|
| EP | 2043382 | A1 | 4/2009 |
| JP | H01-059388 | U | 4/1989 |

(Continued)

*Primary Examiner* — Disler Paul
(74) *Attorney, Agent, or Firm* — Oliff PLC

(57) ABSTRACT

To provide an enclosure structure having relatively high rigidity to a speaker system mounted on a vehicle, and to improve frequency characteristics of sound pressure. The speaker system includes: a hollow framework member extending in a front-back direction of a vehicle; and a speaker unit installed such that an internal space of the framework member is usable as a back cavity. The framework member has a partition member at at least one end of the internal space, and spatial path lengths from the speaker unit to both longitudinal ends of the internal space are substantially the same.

15 Claims, 11 Drawing Sheets

(56) References Cited

U.S. PATENT DOCUMENTS

| | | | | |
|---|---|---|---|---|
| 2014/0086444 | A1* | 3/2014 | Muller | B60J 5/0418 381/389 |
| 2016/0173974 | A1* | 6/2016 | Stys | H04R 1/021 381/86 |

FOREIGN PATENT DOCUMENTS

| | | | |
|---|---|---|---|
| JP | H04-223697 | A | 8/1992 |
| JP | H05-82195 | U | 11/1993 |
| JP | H06-1184 | A | 1/1994 |
| JP | H06-1184 | U | 1/1994 |
| JP | H08-253082 | A | 10/1996 |
| JP | 2008-131199 | A | 6/2008 |
| JP | 2009-118182 | A | 5/2009 |
| JP | 2009-538007 | A | 10/2009 |
| JP | 2015-227939 | A | 12/2015 |
| WO | 2017/038443 | A1 | 3/2017 |

* cited by examiner

SPEAKER SYSTEM AND ENCLOSURE STRUCTURE OF SPEAKER SYSTEM

CROSS-REFERENCE TO RELATED APPLICATIONS

This application is based upon and claims the benefit of prior Japanese Patent Application No. 2018-074183 filed on Apr. 6, 2018, the entire contents of which are incorporated herein by reference.

TECHNICAL FIELD

The present invention relates to a speaker system and an enclosure structure of the speaker system.

BACKGROUND ART

There has hitherto been proposed an on-vehicle speaker system in which a sub-speaker is installed at a sound pressure node (e.g., Patent document 2). Further, there has been proposed a speaker apparatus in which a speaker unit is provided at a position facing a node in a minimum resonant standing wave of a baffle plate (e.g., Patent document 2).

There has also been proposed a technique in which an opening is formed in the side surface on the door hinge side of a speaker box of an automotive door speaker stored in a door by attaching a speaker body to a door inner panel (e.g., Patent document 3). In the present technique, an opening communicating with the opening is formed in a door side panel on the vehicle forward side of the door, and an opening, which communicates with the opening in the door side panel at the time of closing the door, is provided in a cowl side panel on the vehicle backward side of a cowl side communicating with a space in a rocker on the bottom surface. A bass reflex port which communicates the space of the cowl side with the inside of a cabin is provided in the cowl side panel on the cabin inner side of the cowl side. [Patent document 1] Japanese Utility Model Laid-Open No. 1-59388 [Patent document 2] Japanese Patent Laid-Open No. 2008-131199 [Patent document 3] Japanese Patent Laid-Open No. 8-253082 [Patent document 4] U.S. Pat. Laid-Open No. 2009/0279733 [Patent document 5] Japanese Patent Laid-Open No. 2009-1181812 [Patent document 6] Japanese Utility Model Laid-Open No. 5-82195 [Patent document 7] Japanese Patent Laid-Open No. 6-1184

SUMMARY OF THE INVENTION

Technical Problem

When the speaker is mounted on the vehicle, due to the space being limited in the cabin, it has been difficult to provide a back cavity in which frequency characteristics of a sound pressure level come close to being uniform in an audio frequency range. In addition, as an enclosure of the speaker, for example, the door of the vehicle has low rigidity and sensitive to vibration.

An object of the present invention is to provide an enclosure structure having relatively high rigidity to a speaker system mounted on a vehicle, and to improve frequency characteristics of sound pressure.

Solution to Problem

A speaker system according to the present invention includes: a hollow framework member extending in a front-back direction of a vehicle; and a speaker unit installed such that an internal space of the framework member is usable as a back cavity. The framework member has a partition member at at least one end of the internal space, and spatial path lengths from the speaker unit to both longitudinal ends of the internal space are substantially the same.

Since the framework member of the vehicle has relatively high rigidity, using the framework member as a back cavity can reduce a sound leakage. This also eliminates the need to mount a speaker system on the door or the like, thereby improving the flexibility in design of other portions such as the door. Further, providing the partition member enables formation of the internal space to be used as the back cavity of the speaker system in an arbitrary region in the framework member. When the framework member of the vehicle is used, its shape tends to become long in one direction, but by using the partition member to adjust the longitudinal length, it is possible to suppress resonance generated in a low range and expand a reproduceable band of the speaker system. Moreover, by making the spatial path lengths from the speaker unit to both longitudinal ends of the internal space substantially the same, it is possible to dispose the speaker unit in a position facing a sound pressure node in odd-order resonance. This can reduce an influence by peaks and dips of sound pressure in the odd-order resonance. As the framework member to be used as the back cavity, for example, it is preferable to use, like a so-called rocker, a hollow member provided on each of the right and left sides of the vehicle and extending in the front-back direction of the vehicle, but a center console or the like provided at the center of the vehicle may be used as the back cavity.

A housing mounted with the speaker unit may further be provided, and the speaker unit may be connected to the framework member via the housing. When the housing is provided, the housing mounted with the speaker unit is attached to the framework member, so that the operation to attach the speaker system to the vehicle is completed.

The inside of the housing may further communicate with the inside of another hollow member. The use of the other hollow member as the back cavity can ensure a capacity with which vibration of the air can be sufficiently obtained in the back cavity as a whole.

Spatial path lengths from the speaker unit to both ends of another hollow member in the extending direction may be trade substantially the same. The extending direction of the other hollow member is, in other words, the longitudinal direction of the other hollow member. In this manner, with regard to the odd-order resonance generated inside the other hollow member, an influence by peaks and dips of sound pressure can be reduced.

The partition member may be formed of a metal plate or a sound absorbing material. Forming the partition member of metal plate can improve the rigidity of the member. Forming the partition member of the sound absorbing material can reduce an influence by peaks or dips of steep sound pressure.

In an enclosure structure of a speaker system according to another aspect of the present invention, an internal space of a framework member extending in a front-back direction of a vehicle is used as a back cavity, the framework member has a partition member at at least one end of the internal space, and a speaker unit is disposed in a position from which spatial path lengths to both longitudinal ends of the internal space are substantially the same.

Note that the contents described in Means for Solving the Problem can be combined within a range not deviating from the subject and technical idea of the present invention.

Effects of the Invention

An object is to provide an enclosure structure having relatively high rigidity to a speaker system mounted on a vehicle, and to improve frequency characteristics of sound pressure.

DESCRIPTION OF EMBODIMENT

Hereinafter, a configuration according to each embodiment will be described with reference to the drawings.

Embodiment 1

Figure 1:
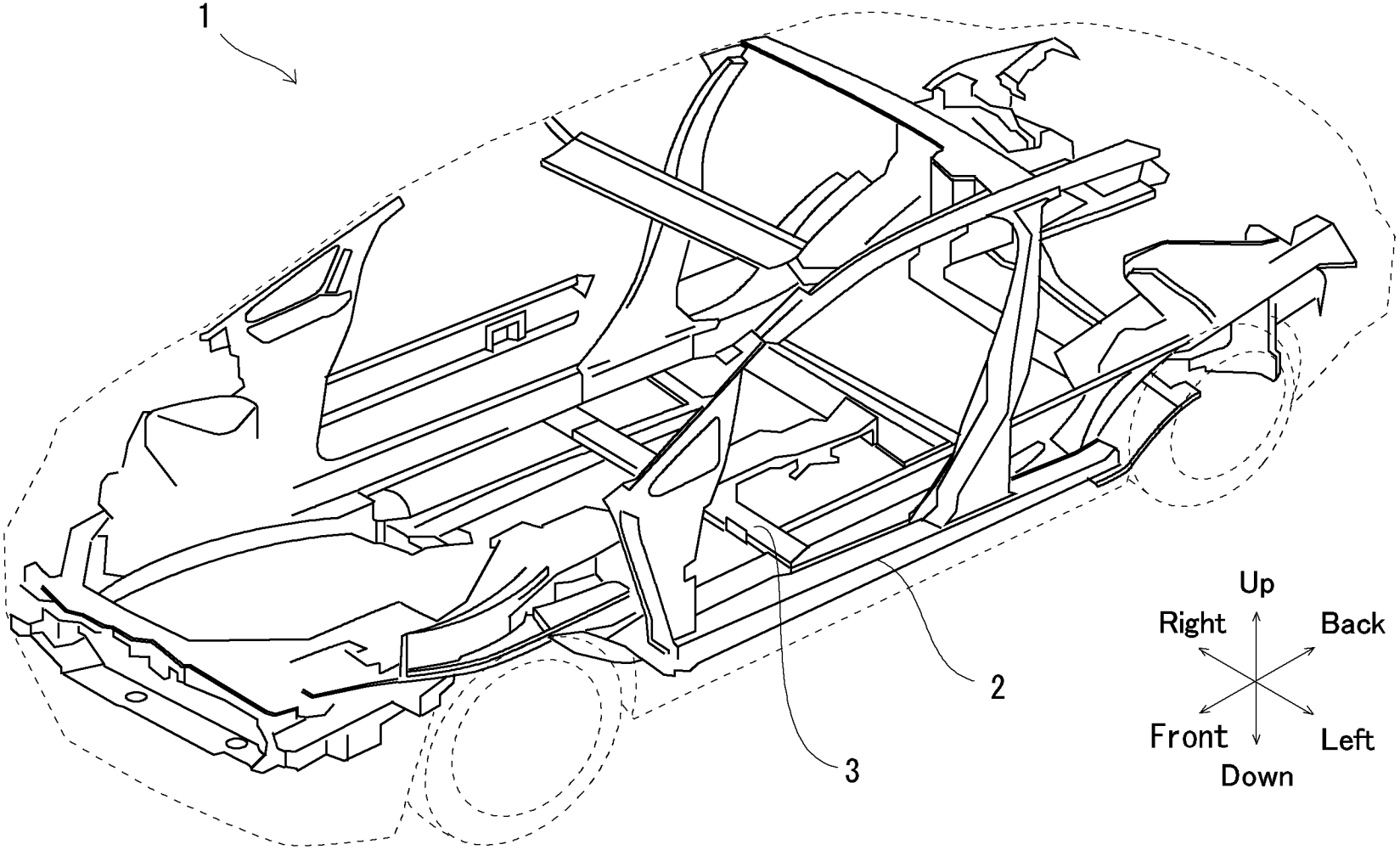
FIG. 1 is a view illustrating an example of a structure of a vehicle.

FIG. 1 is a view illustrating an example of a structure of a vehicle. The example of FIG. 1 illustrates an example of a framework structure of a passenger vehicle. In the present embodiment, a hollow framework member 2 extending in a front-back direction of a vehicle 1 is used as a back cavity of a speaker system. The framework member 2 is positioned in a lower part of a door (not illustrated) provided on the side surface of the vehicle 1 and exists on each of the right and left sides of the vehicle. Further, the framework member 2 has a polygonal cross section such as a substantially hexagonal cross section, and has a cavity on its inside. Note that the framework member 2 is also called a "rocker", a "rocker panel", a "side panel", a side 3647*i*ll", and the like.

Further, the vehicle 1 has another hollow member 3, or the like, extending in a lateral (right-left) direction of the vehicle, for example. The member 3 illustrated in FIG. 1 is a member positioned in a lower part of a seat (not illustrated) and supporting the seat, and is also called a "seat cross" and the like. The framework member 2 and the other member 3 in FIG. 1 are connected to each other. In addition, the member 3 is also hollow.

Note that the framework structure of the vehicle may be a monocoque or a ladder frame. In either case, for example, a hollow portion extending in the front-back direction of the vehicle is used as the back cavity of the speaker system.

Figure 2:
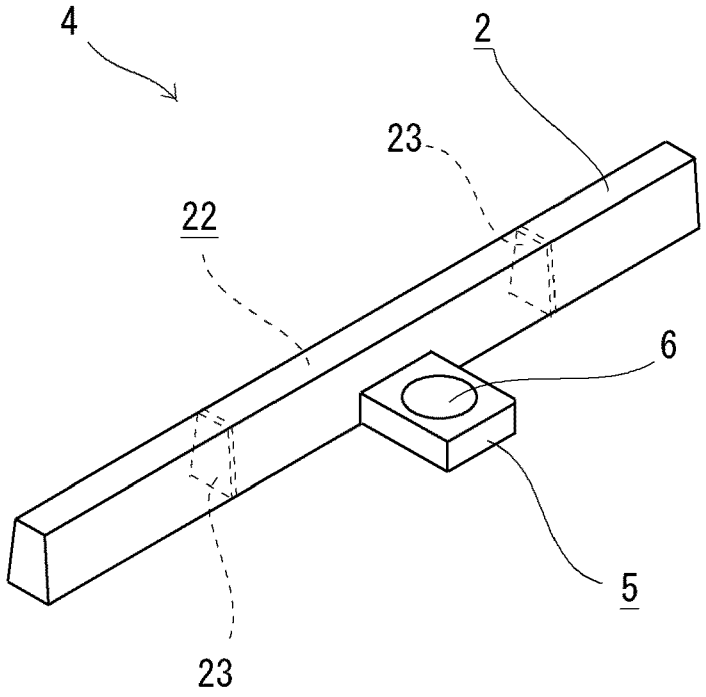
FIG. 2 is a perspective view schematically representing a speaker system according to the present embodiment.
Figure 3:
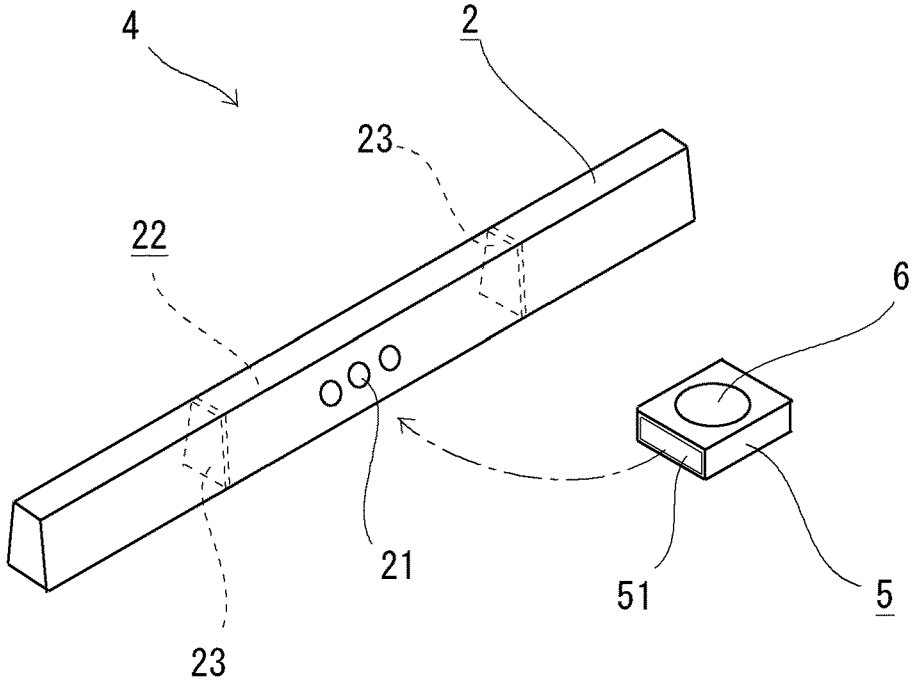
FIG. 3 is an exploded perspective view schematically representing the speaker system according to the present embodiment.

FIG. 2 is a perspective view schematically representing the speaker system according to the first embodiment. FIG. 3 is a schematic exploded perspective view of the speaker system according to the present embodiment. A speaker system 4 is formed by connecting the framework member 2 and a housing 5. That is, the speaker system 4 is provided under the floor near each of the right and left doors of the vehicle 1 illustrated in FIG. 1.

The housing 5 is a box-shaped housing on which a speaker unit 6 is mounted, and as illustrated in FIG. 3, an opening 51 for communicating the space provided behind the speaker unit 6 in the housing 5 with the internal space of the framework member 2 is provided. That is, the speaker unit 6 is connected to the framework member 2 via the housing 5 so that the space in the framework member 2 can be used as the back cavity of the speaker system 4. In the example of FIG. 3, the opening 51 is provided over one surface of the rectangular parallelepiped-shaped housing 5, but the shape of the opening 51 is not particularly limited. Note that the speaker unit 6 is a part that converts an electric signal to vibration, and its structure, such as a cone type, a dome type, a horn type, or a ribbon type, is not particularly limited.

As illustrated in FIG. 3, the framework member 2 is provided with an opening 21 for communicating its internal space 22 with the inside of the housing 5. The shape of the opening 21 is not particularly limited and can be determined based, for example, on balance between the strength of the framework member 2 and the acoustic design of the speaker system. The opening 21 may be a notch provided for joining the framework member 2 and the housing 5. Forming the opening 21 into, for example, a circular hole can prevent a decrease in strength of the framework member 2.

Moreover, the framework member 2 is provided with a partition member 23 for further partitioning the cavity on the inside and forming the predetermined internal space 22. In other words, the partition member 23 closes the longitudinal end of the internal space 22 provided inside the framework member 2 and used as the back cavity of the speaker system. Further, the speaker unit 6 is disposed in a position facing substantially the longitudinal center of the internal space 22. In other words, the spatial path lengths from the speaker unit 6 to both longitudinal ends of the predetermined internal space 22 are substantially the same.

The partition member 23 may be formed of a metal plate or formed of a sound absorbing material. Forming the partition member of metal plate can improve the rigidity of the member. Forming the partition member of the sound absorbing material can reduce an influence by peaks or dips of steep sound pressure.

As described above, in the enclosure structure of the speaker system, the internal space of the framework member extending in the front-back direction of the vehicle is used as the back cavity of the speaker system. Further, the framework member has a partition member at at least one end of the internal space, and the speaker unit is disposed in a position from which spatial path lengths to both longitudinal ends of the internal space are substantially the same.

Comparative Examples

Figure 4:
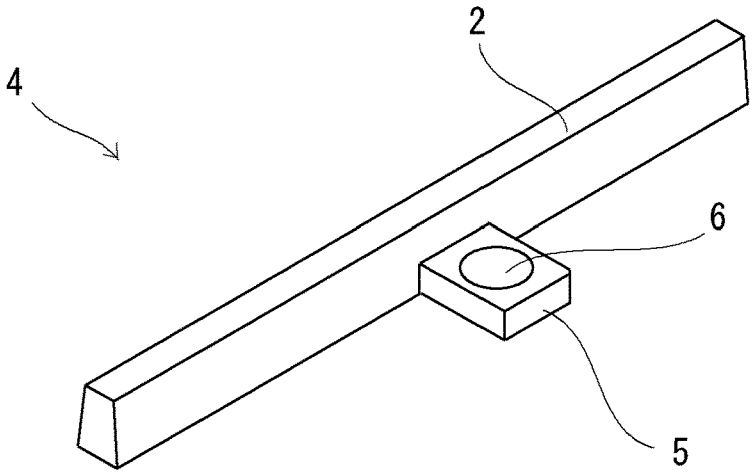
FIG. 4 is a view illustrating an example of a speaker system according to a first comparative example.

FIG. 4 is a view illustrating an example of a speaker system according to a first comparative example (Comparative Example 1). In the present comparative example, the housing 5 is connected to substantially the longitudinal center of the framework member 2. That is, a sound source exists at substantially the center of the closed tubular back cavity of the speaker system. Note that both longitudinal ends of the framework member 2 are assumed to be closed.

Figure 5:
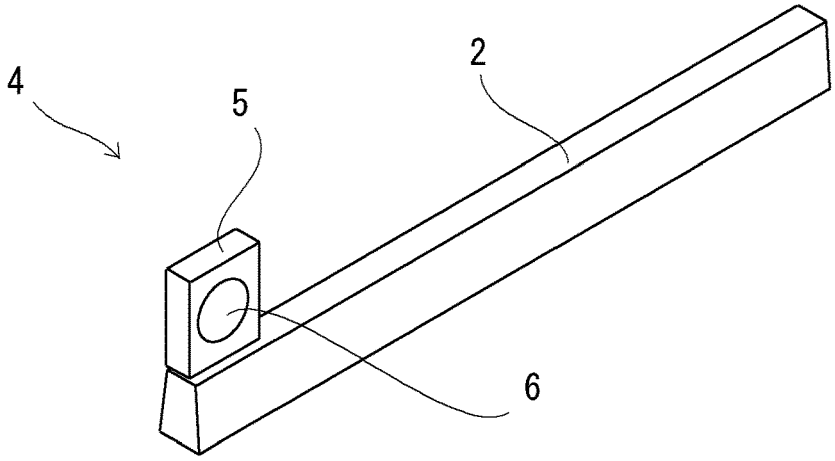
FIG. 5 is a view illustrating an example of a speaker system according to a second comparative example.

FIG. 5 is a view illustrating an example of a speaker system according to a second comparative example (Comparative Example 2). In the present comparative example, the housing 5 is connected to one longitudinal end of the framework member 2. That is, the sound source exists at the end of the closed tubular back cavity of the speaker system.

Figure 6:
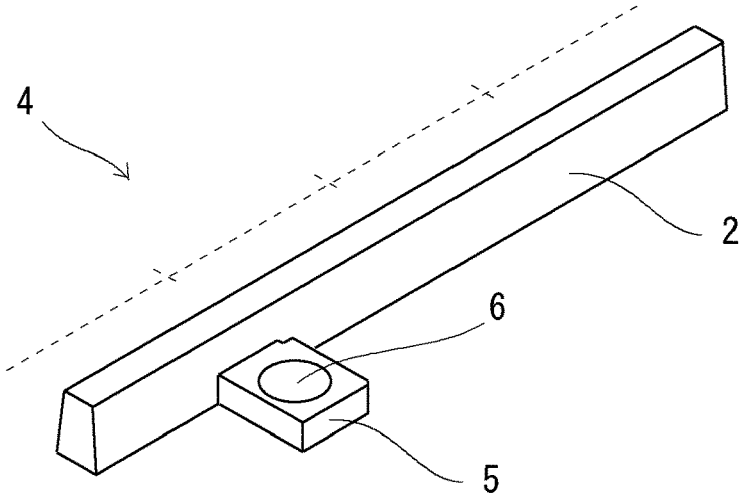
FIG. 6 is a view illustrating an example of a speaker system according to a third comparative example.

FIG. 6 is a view illustrating an example of a speaker system according to a third comparative example (Comparative Example 3). In the present comparative example, the housing 5 is connected to a position being about a quarter of the total length from one end of the framework member 2. That is, the sound source exists in a position being about a quarter from the end of the closed tubular back cavity of the speaker system.

Figure 7:
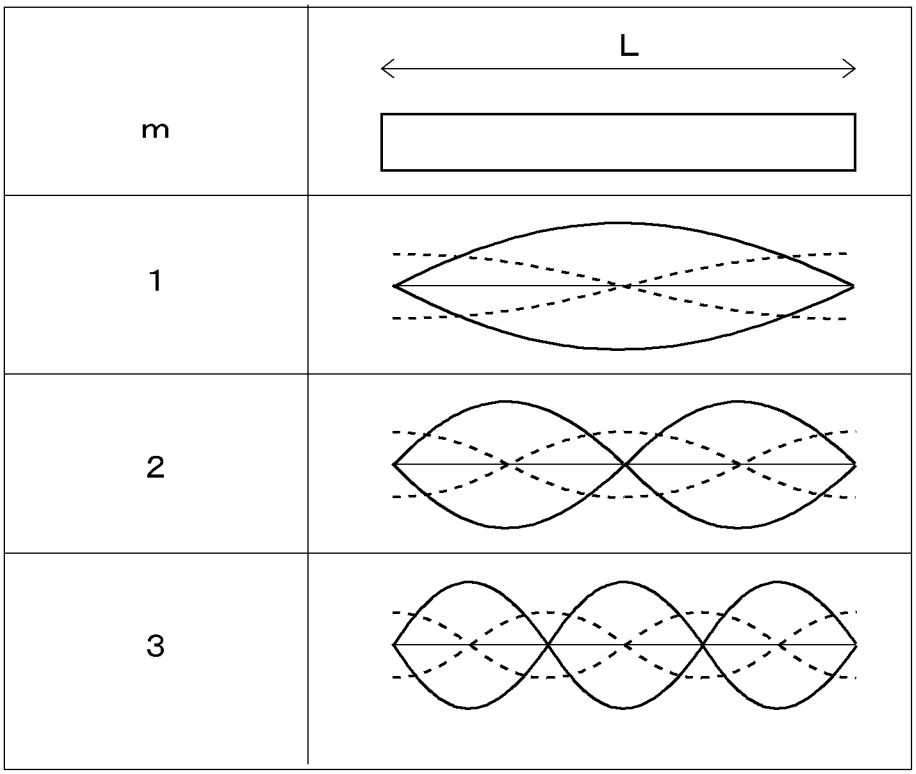
FIG. 7 is a diagram for explaining resonance of a closed tube.

FIG. 7 is a diagram for explaining resonance of the closed tube. The closed tube in FIG. 7 schematically represents the inside of the framework member 2. As described above, the framework member 2 is a tubular structural body with both ends closed and has a cavity on the inside. A solid-line wave represents displacement of an m-order (m=1, 2, 3, . . . ) wavelength with which resonance occurs in a closed tube having a longitudinal length L. A broken-line wave represents a change in pressure generated in each standing wave.

A wavelength $l_m$ is obtained by Formula (1) below:

$$l_m=2L/m \quad (1)$$

A frequency $f_m$ is obtained by Formula (2) below. Note that v represents a sound velocity:

$$f_m=m(v/2L) \quad (2)$$

As illustrated in FIG. 7, each of the longitudinal ends of the closed tube corresponds to a sound pressure antinode in the case of any order. On the other hand, the longitudinal center of the closed tube corresponds to the sound pressure antinode in even-order resonance, but corresponds to the sound pressure node in odd-order resonance. Therefore, when the sound source is disposed at the end of the closed tube, peaks and dips are generated in frequency characteristics of sound pressure at any order. On the other hand, when the sound source is disposed at the center of the closed tube, peaks and dips of sound pressure are not generated in the odd-order resonance. In other words, an influence by peaks and dips of sound pressure are exerted only in the case of resonance at a second order or a larger even order.

Figure 8A:
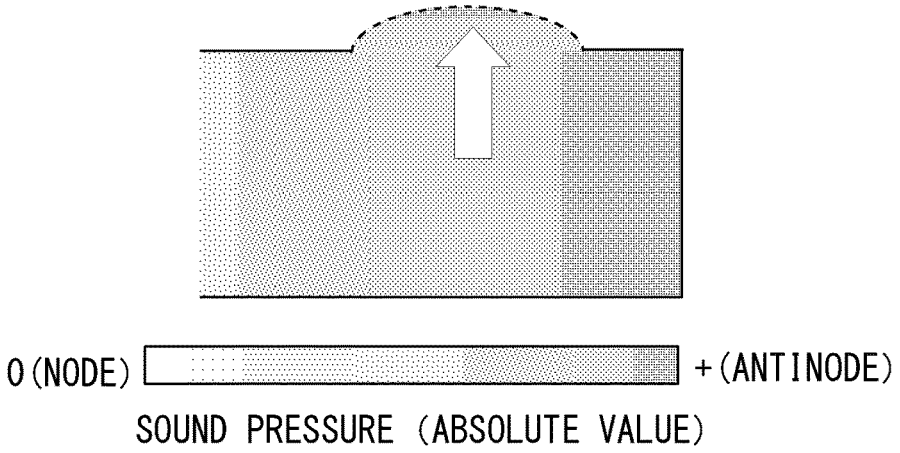
FIG. 8A is a diagram for explaining an influence exerted by sound pressure on a vibration plate of a speaker.
Figure 8B:
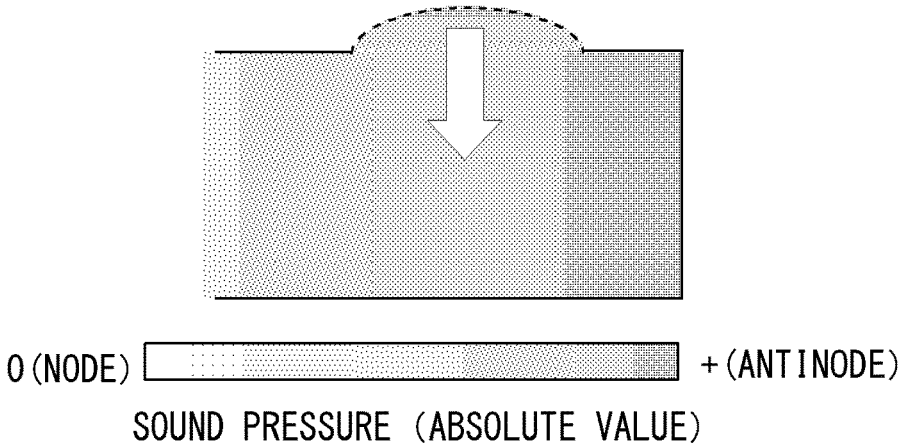
FIG. 8B is a diagram for explaining an influence exerted by sound pressure on the vibration plate of the speaker.
Figure 8C:
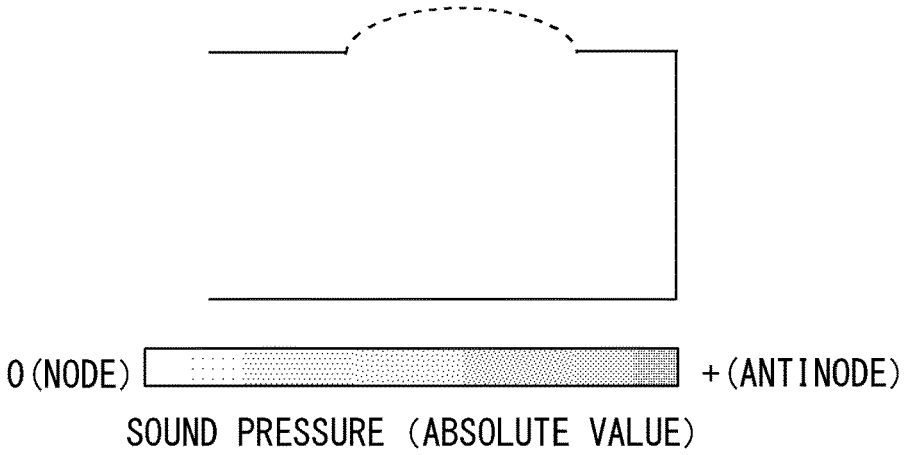
FIG. 8C is a diagram for explaining an influence exerted by sound pressure on the vibration plate of the speaker.

FIGS. 8A to 8C are diagrams for explaining an influence exerted by sound pressure on a vibration plate of the speaker unit. In each of FIGS. 8A to 8C, an absolute value of sound pressure of the back cavity is represented by a dot density. The displacement of the vibration plate of the speaker unit is represented by a dotted curve. An arrow represents a direction of force in which a pressure field of the sound pressure acts on the vibration plate of the speaker. FIG. 8A illustrates an example in which positive sound pressure influences the speaker disposed at the sound pressure antinode. In the example of FIG. 8A, the vibration of the vibration plate and the sound pressure are in the same phase, and the sound pressure promotes driving of the vibration plate. FIG. 8B illustrates an example in which negative sound pressure influences the speaker disposed at the sound pressure antinode. In the example of FIG. 8B, the vibration of the vibration plate and the sound pressure are in the reversed phase, and the sound pressure reduces driving of the vibration plate. FIG. 8C illustrates an influence by sound pressure on the speaker disposed at the sound pressure node. In the example of FIG. 8C, the vibration of the vibration plate is not influenced by the sound pressure and becomes equivalent to that in a case where the capacity of the back cavity is infinite.

Figure 9:
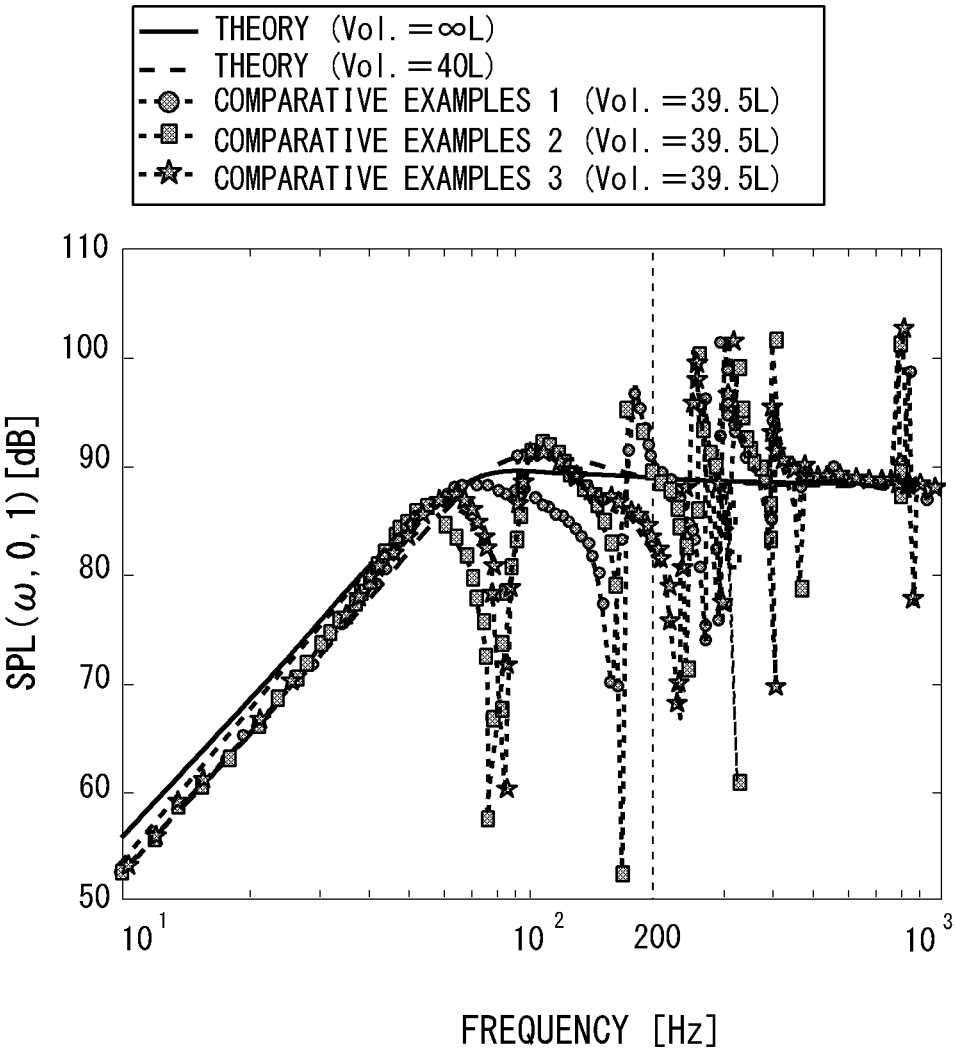
FIG. 9 is a diagram illustrating simulation results of frequency characteristics of sound pressure regarding speaker systems according to Comparative Examples 1 to 3.
Figure 10:
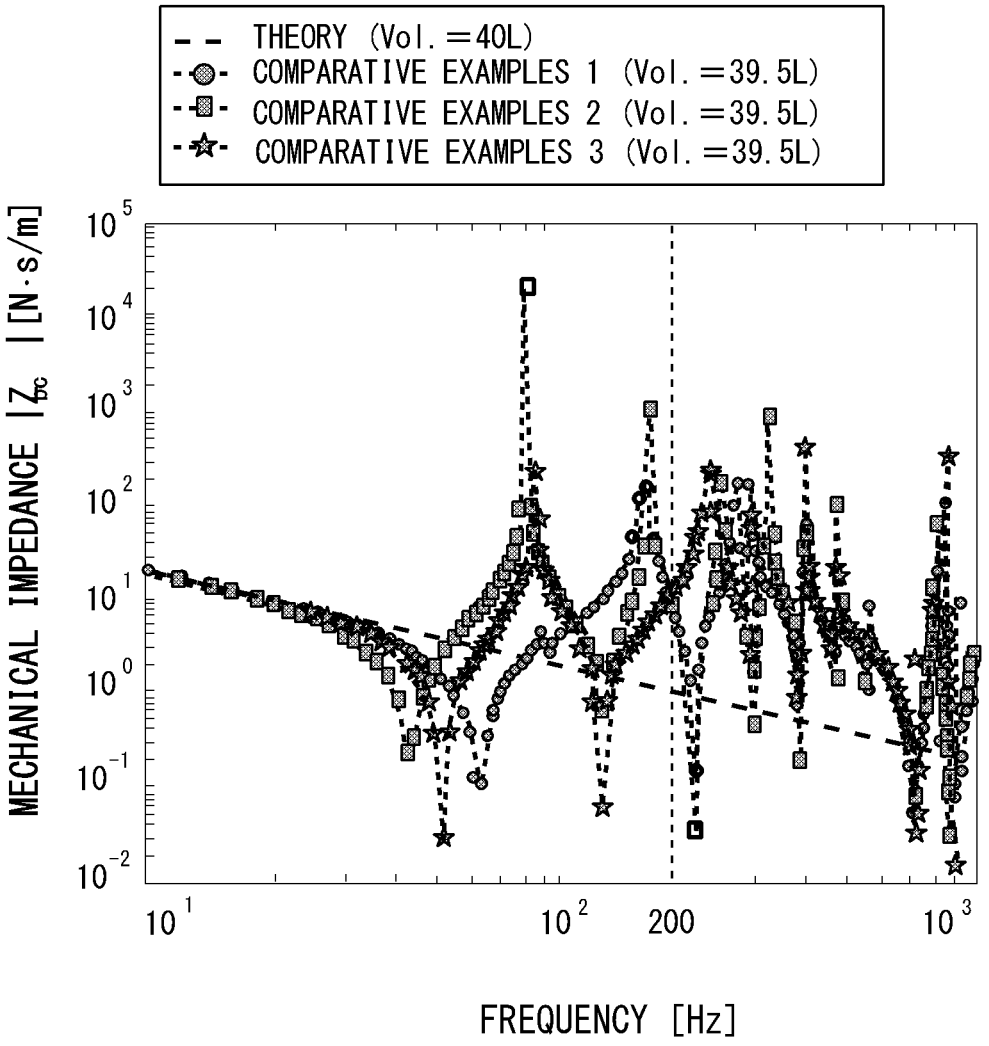
FIG. 10 is a diagram illustrating simulation results of mechanical impedance characteristics regarding the speaker systems according to Comparative Examples 1 to 3.

FIG. 9 is a diagram illustrating simulation results of frequency characteristics of sound pressure regarding the speaker systems according to Comparative Examples 1 to 3. FIG. 10 is a diagram illustrating simulation results of mechanical impedance characteristics regarding the speaker systems according to Comparative Examples 1 to 3. The simulation was performed in such a manner that mechanical impedance of the cavity in the framework member 2 is approximately calculated by numeral analysis, and a sound pressure level in a position one meter (m) ahead of the speaker unit having an infinite baffle is obtained by using the calculation results.

In the graph of FIG. 9, a vertical axis indicates a sound pressure level (SPL) [dB], and a horizontal axis indicates a frequency [Hz]. In the graph of FIG. 10, a vertical axis indicates a mechanical impedance [N·s/m], and a horizontal axis indicates a frequency [Hz]. A solid line of FIG. 9 indicates a theoretical frequency characteristic in a case where the volume of the back cavity is infinite. A broken line plotting no figure in each of FIGS. 9 and 10 indicates a theoretical frequency characteristic in a case where the volume of the back cavity is 40.0 litters (L). A broken line plotting circles indicates a frequency characteristic in the case of the speaker system according to Comparative Example 1. A broken line plotting quadrates indicates a frequency characteristic in the case of the speaker system according to Comparative Example 2. A broken line plotting stars indicates a frequency characteristic in the case of the speaker system according to Comparative Example 3. The volume of the back cavity of the speaker system according to each of Comparative Examples 1 to 3 is 39.5 L. Further, a frequency of 200 Hz indicated by a vertical broken line in each of FIGS. 9 and 10 is a standard for the upper Limit of a general mid-woofer reproduction band. In the speaker system according to Comparative Example 1, as compared with Comparative Example 2 and the like where the housing 5 is connected to the end, peaks and dips in a primary resonance frequency (about 90 Hz) can be avoided.

Action/Effect

As understood from FIGS. 9 and 10, when the housing 5 is connected to substantially the longitudinal center of the closed tubular back cavity as in Comparative Example 1, the frequency at which the dip of the sound pressure level or the mechanical impedance is generated becomes higher. In addition, in the case of Comparative Example 1, amplitude from an average sound pressure level or mechanical impedance is smaller than in the case of Comparative Examples 2 and 3. Therefore, by disposing the sound source at substantially the center of the cavity inside the framework member 2 that functions as the back cavity of the speaker system, an influence by peaks and dips of sound pressure which are generated by resonance can be made smaller than in a case where the sound source is disposed at the end of the cavity, for example to expand the reproduction band.

In the speaker system 4 according to Embodiment 1 described above, the spatial path lengths from the speaker unit 6 to two longitudinal ends of the predetermined internal space 22 are substantially the same. That is, it is possible to dispose the sound source at the sound pressure node generated by odd-order resonance, and make small an influence by peaks and dips of the sound pressure.

Further, there are cases where a rib or the like is provided in the framework member 2 to ensure the strength, and the entire cavity in the framework member 2 is difficult to use as the back cavity of the speaker system. In Embodiment 1 described above, by providing the partition member 23, the internal space to be used as the back cavity of the speaker system 4 can be formed in an arbitrary region in the framework member 2. Further, the resonance frequency in the tubular structural body is inversely proportional to the longitudinal length of the tube. Therefore, shortening the tube with, for example, the partition member 23 can reduce resonance in a low range and expand a reproduceable band of the speaker system.

Further, as in the rocker illustrated in FIG. 1, when the hollow framework member provided on each of the right and left sides of the vehicle and extending in the front-back direction of the vehicle is used as the back cavity, the position of the speaker system 4 provided in the cabin becomes preferable. As thus described, it is possible to provide the enclosure structure having relatively high rigidity to the speaker system mounted on the vehicle, and to improve frequency characteristics of sound pressure.

Embodiment 2

Figure 11:
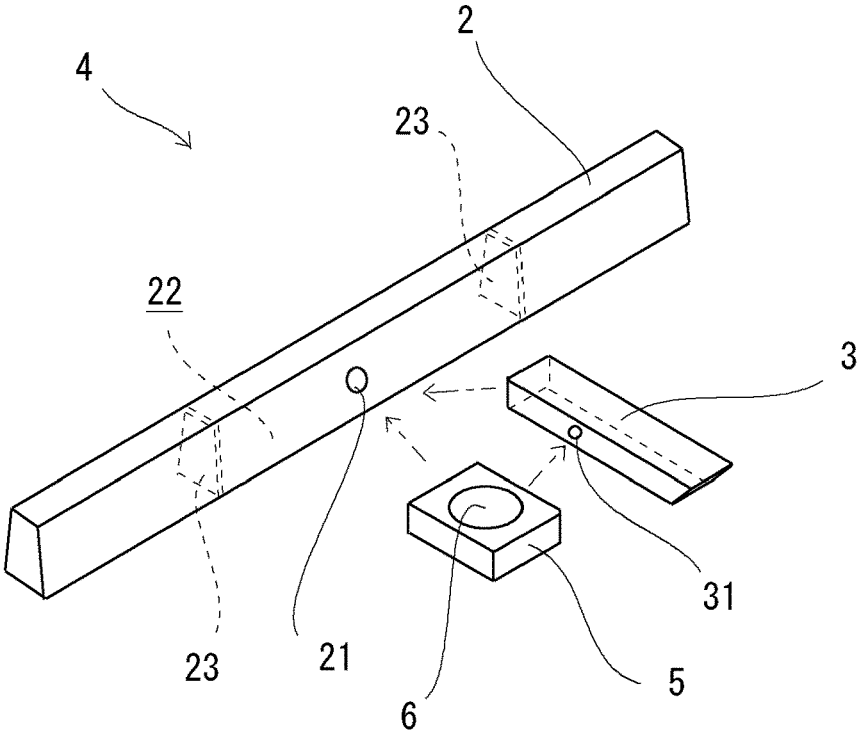
FIG. 11 is an exploded perspective view schematically representing a speaker system according to a second embodiment.

FIG. 11 is an exploded perspective view schematically representing a speaker system according to a second embodiment. In the present embodiment, the same numeral is provided to a similar constituent to that in the embodiment described above, and its description is omitted.

The speaker system 4 according to the present embodiment is further provided with the other hollow member 3. As the member 3, for example, a seat cross or the like illustrated in FIG. 1 can be used. The inside of the housing 5 where the speaker unit 6 is mounted and the inside of the other hollow member 3 also communicate with each other via an opening 31. The use of the other member 3 as the back cavity can increase the capacity of the back cavity and ensure a capacity with which vibration of the air can be sufficiently obtained as a whole.

Figure 12:
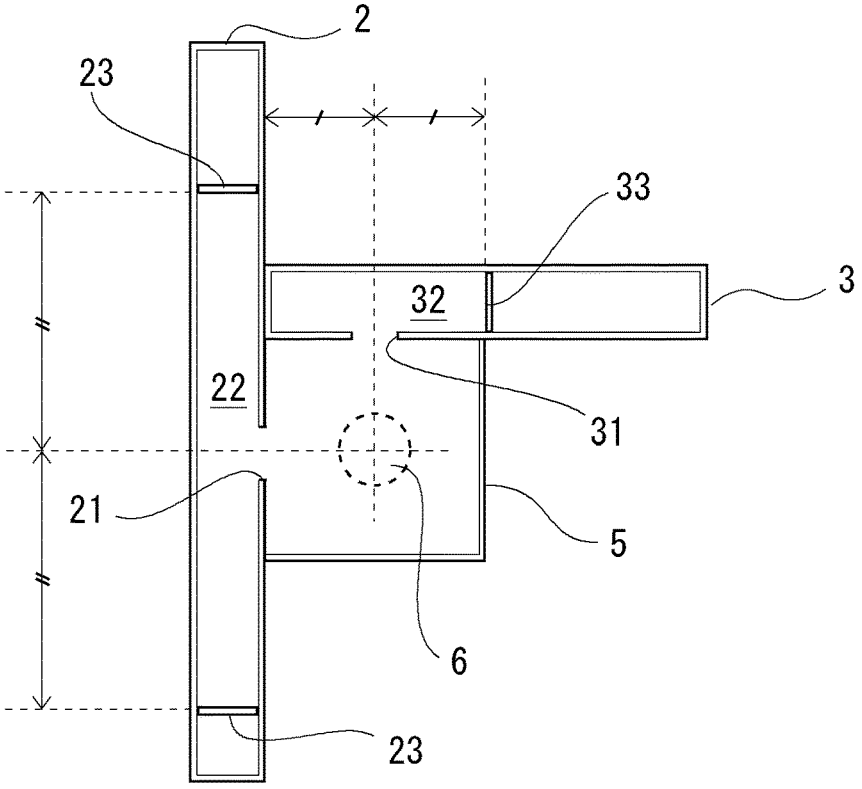
FIG. 12 is a sectional view horizontally cut off the speaker system according to the second embodiment.

FIG. 12 is a schematic sectional view of the speaker system 4 according to the present embodiment. The example of FIG. 12 represents an internal structure of the speaker system 4 viewed from the top. As illustrated in FIG. 12, the framework member 2 has the opening 21 at substantially the longitudinal center, and the member 3 has the opening 31 at substantially the longitudinal center. The speaker unit 6 is then disposed in a position facing substantially the longitudinal center of the framework member 2 and facing substantially the longitudinal center of the member 3. In other words, the spatial path lengths from the speaker unit 6 to both ends of the internal space 22 are substantially the same, and the spatial path lengths from the speaker unit 6 to both longitudinal ends of an internal space 32 of the other hollow member 3 are also substantially the same. Note that a partition member 33 may also be provided inside the member 3. According to the present embodiment, it is possible to reduce generation of resonance in the back cavity provided inside the member 3. In this manner, with regard to the odd-order resonance generated inside another hollow member, an influence by peaks and dips of sound pressure can be reduced. Note that the framework member 2 may not be connected to the other member 3.

Figure 13:
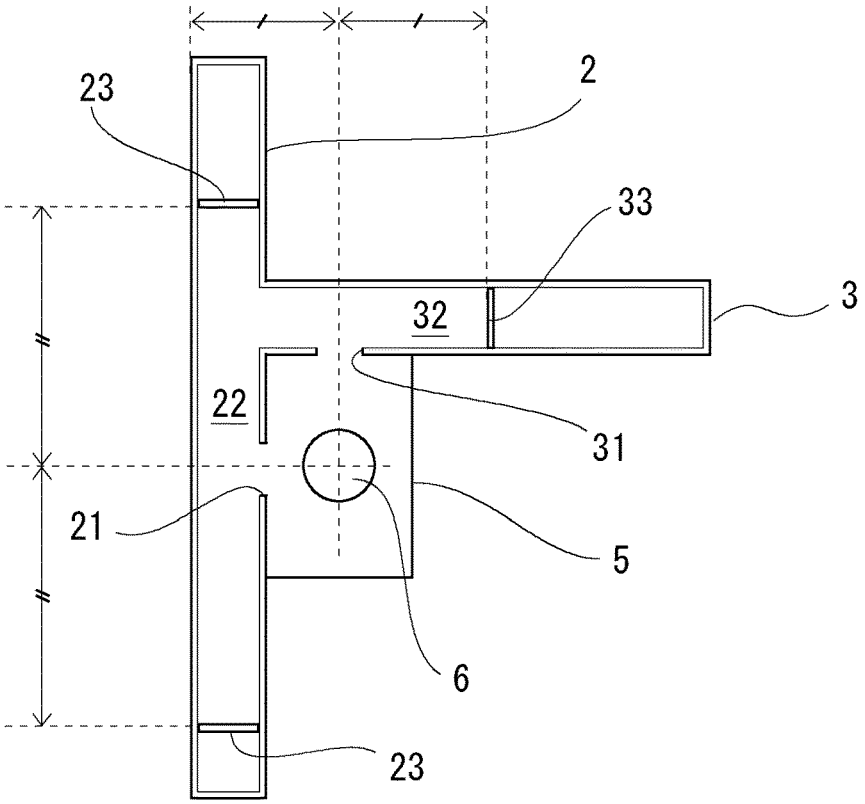
FIG. 13 is a sectional view horizontally cut off a speaker system according to a modified example.

FIG. 13 is a schematic sectional view of the speaker system 4 according to a modified example. The example of FIG. 13 represents an internal structure of the speaker system 4 viewed from the top. As illustrated in FIG. 13, the inside of the framework member 2 and the inside of the member 3 may be configured to further communicate with each other. Also, in the present embodiment, the speaker unit 6 is provided in the position facing substantially the longitudinal center of the framework member 2. Further, in the present embodiment, the speaker unit 6 is disposed in a position facing substantially the center between both ends of the member 3 in the extending direction. As illustrated in FIG. 13, when one end of the other member 3 is connected to the side surface of the framework member 2, resonance occurs with the length between the other end of the other member 3 (the partition member 33) and the side surface of the framework member 2, positioned on the longitudinal extension of the member 3, taken as a half wavelength. Since a sound pressure node is thus generated at substantially the center between the two ends, the speaker unit 6 is provided at a position facing the node. In other words, the spatial path lengths from the speaker unit 6 to both ends of the internal space 22 of the framework member 2 are substantially the same, and the spatial path lengths from the speaker unit 6 to both ends of the other hollow member 3 in the extending direction are also substantially the same. In this manner, with regard to the odd-order resonance generated inside the other hollow member, an influence by peaks and dips of sound pressure can be reduced.

Figure 14:
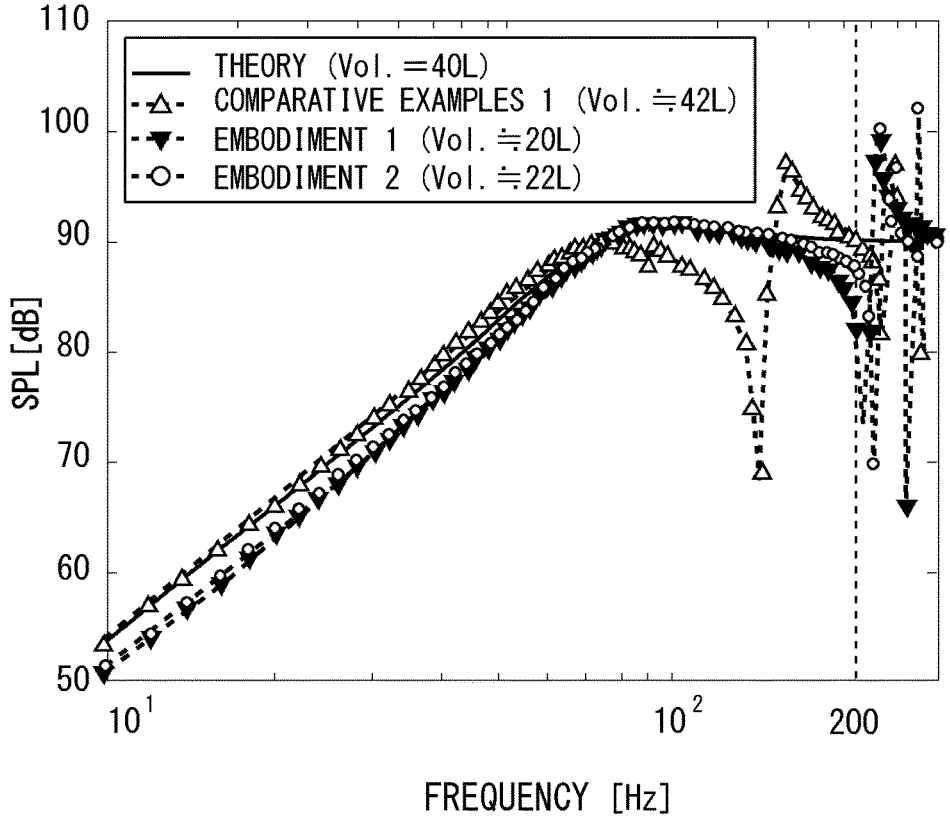
FIG. 14 is a diagram for explaining simulation results of frequency characteristics of a sound pressure level in the speaker systems according to Comparative Example 1 and Embodiments 1 and 2.

FIG. 14 is a diagram for explaining simulation results of frequency characteristics of the sound pressure level in the speaker systems according to Comparative Example 1 and Embodiments 2 and 3. A solid line of FIG. 14 is a graph indicating an example of a speaker system frequency characteristic in a theory of the back cavity having a capacity of 40 L. A broken line plotting white triangles is a graph indicating a frequency characteristic in a case where the framework member 2 according to Comparative Example 1 is used as the back cavity. Note that the longitudinal length of the back cavity was set to 1900 mm, the capacity was set to 42 L, and the area of the opening connecting the inside of the housing 5 and the inside of the framework member 2 was set to 46 $cm^2$. A broken line plotting black triangles is a graph indicating a frequency characteristic in a case where the framework member 2 having the partition member 23 according to Embodiment 1 is used as the back cavity. Note that the longitudinal length of the internal space 22 formed between the two partition members 23 was set to 690 mm, the capacity was set to 20 L, and the area of the opening connecting the inside of the housing 5 and the inside of the framework member 2 was set to 46 $cm^2$. A broken line plotting circles is a graph indicating a frequency characteristic in a case where the framework member 2 further connected with the other hollow member 3 according to Embodiment 2 and having the partition member 23 is used as the back cavity. Note that the longitudinal length of the internal space 22 formed between the two partition members 23 was set to 690 mm, the capacity of the entire back cavity was set to 22 L, and the area of the opening connecting the inside of the housing 5 and each of the insides of the framework member 2 and the member 3 was set to 68 $cm^2$.

As illustrated in FIG. 14, the speaker system according to Embodiment 1 can expand the region with a uniform sound pressure level to the vicinity of 200 Hz. Hence this can also be used for the purpose of covering the mid-woofer band. Further, in the speaker system according to Embodiment 2, the capacity of the back cavity can be increased and the sound pressure level can be made higher as a whole than in the case of Embodiment 1. Moreover, increasing the connection area between the housing 5 and the back cavity enables lowering of the sound pressure inside the housing 5 at the time of resonance and thus has a dip reducing effect.

Comparative Example

Figure 15:
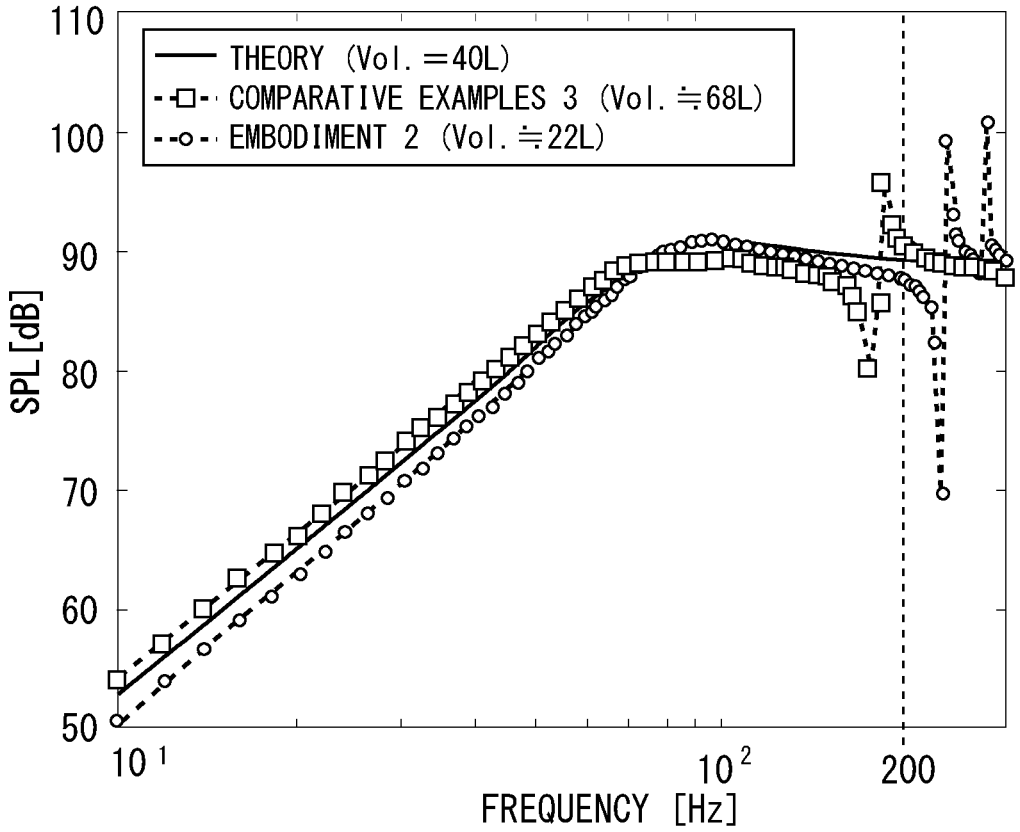
FIG. 15 is a diagram of an example of simulation results of frequency characteristics of the sound pressure level according to the third comparative example.

FIG. 15 is an example of simulation results of frequency characteristics of the sound pressure level according to a third comparative example (Comparative Example 3). A solid line of FIG. 15 is a graph indicating an example of a speaker system frequency characteristic in a theory of the back cavity having a capacity of 40 L. A broken line plotting quadrates indicates a frequency characteristic of the speaker system according to Comparative Example 3. The speaker system according to Comparative Example 3 is mounted on the door of the vehicle.

Figure 16:
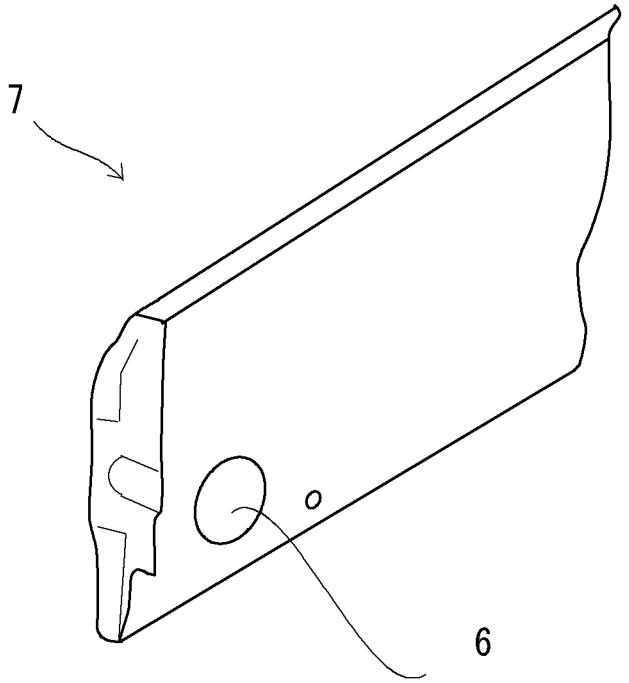
FIG. 16 is a perspective view illustrating an example of the speaker system mounted on the door.

FIG. 16 is a perspective view illustrating an example of the speaker system mounted on the door. In the example of FIG. 16, the back cavity of the speaker system is provided inside a door 7 and buried therein such that the speaker unit 6 faces the cabin. In Comparative Example 3, the capacity of the back cavity was set to about 68 L. A broken line plotting circles indicates an example of a frequency characteristic in the case of the speaker system according to Embodiment 2.

Since the speaker system according to Embodiment 2 and the speaker system according to Comparative Example 3 are different in the capacity of the back cavity, the gain of the speaker system according to Embodiment 2 is little lower in a low range but higher in a band of about 80 Hz or above than in Comparative Example 3. In addition, the frequency band until the peak and dip are generated can be taken wider in Embodiment 2, and the reproduceable band has been expanded.

As described above, the speaker system according to the present embodiment can realize performance equivalent to or higher than that in the speaker mounted on the door. With the door being light-weight and having relatively low rigidity, a sound may be leaked to the outside in some cases, but using the framework member 2 of the vehicle as the back cavity can reduce a sound leakage. Due to no need for mounting the speaker system on the door, the flexibility in design of the door improves, thus enabling increase in capacity of a door pocket and reduction in weight thereof.

Others

In the above, the embodiments of the speaker system according to the present invention have been represented, but each of these is an example of the present invention, and the present invention is not limited to the aspects described above. Further, the contents of each of the embodiments can be combined within a range not deviating from the gist of the present invention. Moreover, the present invention can also be specified as an enclosure structure of the speaker system described above.

Figure 17:
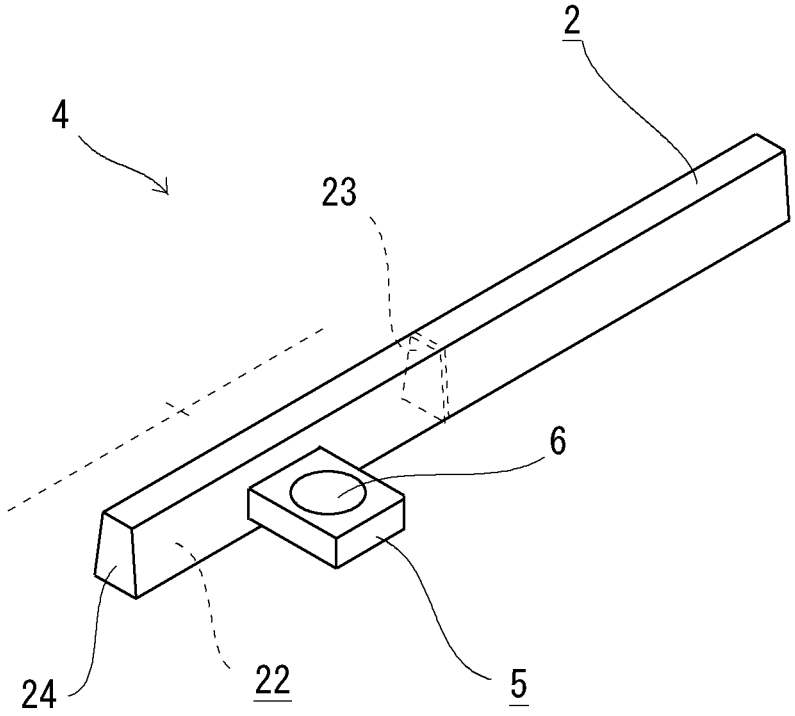
FIG. 17 is a perspective view illustrating an example of a speaker system according to a modified example.

FIG. 17 is a perspective view illustrating an example of a speaker system according to a modified example. As illustrated in FIG. 17, the framework member 2 may be configured such that one end of the internal space 22 is closed by the partition member 23 and the other end of the internal space 22 has an end wall 24 provided in the framework member 2. That is, the framework member 2 has the partition member 23 at least one end of the internal space 22. Also, in the example of FIG. 17, the spatial path lengths from the speaker unit 6 to both longitudinal ends of the internal space 22 are substantially the same. Also, with such a configuration, it is possible to adjust the longitudinal length of the back cavity of the speaker system 4 and expand the reproduceable frequency band.

The speaker unit 6 may be connected to the framework member 2 not through the box-shaped housing 5. For example, the speaker unit 6 may be directly connected to the opening provided in the framework member 2 or may be connected via a member such as a baffle plate. Also, with such a configuration, the speaker unit 6 can be installed such that the internal space 22 of the framework member 2 is usable as the back cavity of the speaker system. On the other hand, in the case of providing the housing 5, a unit to be a part of the present system can be formed to facilitate the operation to attach the unit to the framework member 2.

Note that a center console or the like provided at the front center in the cabin may be used as the back cavity.

Further, the speaker system according to the embodiments described above may be formed to be a bass reflex type. For example, a duct having a predetermined resonance frequency is further provided in the back cavity of the speaker system. The resonance frequency can be determined as appropriate such that a band with a uniform frequency characteristic expands on the low range side.

REFERENCE SIGNS LIST

1: Vehicle
2: Framework member
21: Opening
22: Internal space
23: Partition member
24: End wall
3: Another hollow member
31: Opening
32: Internal space
33: Partition member
4: Speaker system
5: Housing
51: Opening
6: Speaker unit

The invention claimed is:

1. A speaker system comprising:

a hollow framework member extending in a front-back direction of a vehicle and having an internal cavity;

at least one partition member attached within the internal cavity of the framework member, the at least one partition member forming a first longitudinal end of an internal space within the framework member, the internal space extending between the first longitudinal end and a second longitudinal end and having a volume smaller than a volume of the internal cavity; and a speaker unit attached to the framework member so that a space behind the speaker unit communicates with the internal space of the framework member so that the internal space is usable as a back cavity of the speaker system, wherein the space behind the speaker unit is communicated with a central portion of the internal space of the framework member relative to the front-back direction of the vehicle so that spatial path lengths from the central portion of the internal space at which the speaker unit is communicated with the internal space to both the first and second longitudinal ends of the internal space relative to the front-back direction of the vehicle are substantially the same.

2. The speaker system according to claim 1, further comprising a housing to which the speaker unit is mounted, wherein the speaker unit is connected to the framework member via the housing.

3. The speaker system according to claim 2, wherein an inside of the housing communicates with the internal space of the framework member through a first surface of the housing, the inside of the housing further communicates with an inside of another hollow member through a second surface of the housing which is different from the first surface, and the another hollow member extends substantially orthogonal to the framework member.

4. The speaker system according to claim 3, wherein spatial path lengths from the speaker unit to both ends of the another hollow member in an extending direction of the another hollow member are substantially the same.

5. The speaker system according to claim 1, wherein the partition member is formed of a metal plate or a sound absorbing material.

6. An enclosure structure of a speaker system, wherein an internal space of a hollow framework member extending in a front-back direction of a vehicle is used as a back cavity of the speaker system, the framework member having an internal cavity, at least one partition member is attached within the internal cavity of the framework member, the at least one partition member forming a first longitudinal end of the internal space within the framework member, the internal space extending between the first longitudinal end and a second longitudinal end and having a volume smaller than a volume of the internal cavity, and a speaker unit is attached to the framework member so that a space behind the speaker unit communicates with the internal space of the framework member so that the internal space is used as the back cavity, wherein the space behind the speaker unit is communicated with a central portion of the internal space of the framework member relative to the front-back direction of the vehicle so that spatial path lengths from the central portion of the internal space at which the speaker unit is communicated with the internal space to both the first and second longitudinal ends of the internal space relative to the front-back direction of the vehicle are substantially the same.

7. The enclosure structure according to claim 6, further comprising a housing to which the speaker unit is mounted, wherein the speaker unit is connected to the framework member via the housing.

8. The enclosure structure according to claim 7, wherein an inside of the housing communicates with the internal space of the framework member through a first surface of the housing, the inside of the housing further communicates with an inside of another hollow member through a second surface of the housing which is different from the first surface, and the another hollow member extends substantially orthogonal to the framework member.

9. The enclosure structure according to claim 8, wherein spatial path lengths from the speaker unit to both ends of the another hollow member in an extending direction of the another hollow member are substantially the same.

10. The enclosure structure according to claim 6, wherein the partition member is formed of a metal plate or a sound absorbing material.

11. A speaker system comprising:

a hollow framework member having an internal cavity;

at least one partition member attached within the internal cavity of the framework member, the at least one partition member forming a first longitudinal end of an internal space within the framework member, the internal space extending between the first longitudinal end and a second longitudinal end and having a volume smaller than a volume of the internal cavity; and a speaker unit attached to the framework member so that a space behind the speaker unit communicates with the internal space of the framework member so that the internal space is usable as a back cavity of the speaker system, wherein the space behind the speaker unit is communicated with a central portion of the internal space of the framework member so that spatial path lengths from the central portion of the internal space at which the speaker unit is communicated with the internal space to both the first and second longitudinal ends of the internal space are substantially the same.

12. The speaker system according to claim 11, further comprising a housing to which the speaker unit is mounted, wherein the speaker unit is connected to the framework member via the housing.

13. The speaker system according to claim 12, wherein an inside of the housing communicates with the internal space of the framework member through a first surface of the housing, the inside of the housing further communicates with an inside of another hollow member through a second surface of the housing which is different from the first surface, and the another hollow member extends substantially orthogonal to the framework member.

14. The speaker system according to claim 13, wherein spatial path lengths from the speaker unit to both ends of the another hollow member in an extending direction of the another hollow member are substantially the same.

15. The speaker system according to claim 11, wherein the partition member is formed of a metal plate or a sound absorbing material.

* * * * *